US008708696B2

(12) United States Patent
Ghoniem et al.

(10) Patent No.: US 8,708,696 B2
(45) Date of Patent: Apr. 29, 2014

(54) SWIRL-COUNTER-SWIRL MICROJETS FOR THERMOACOUSTIC INSTABILITY SUPPRESSION

(75) Inventors: Ahmed F. Ghoniem, Winchester, MA (US); Zachary A. LaBry, Somerville, MA (US); Santosh J. Shanbhogue, Cambridge, MA (US); Raymond L. Speth, Somerville, MA (US)

(73) Assignee: Massachusetts Institute of Technology, Cambridge, MA (US)

( * ) Notice: Subject to any disclaimer, the term of this patent is extended or adjusted under 35 U.S.C. 154(b) by 249 days.

(21) Appl. No.: 12/941,177

(22) Filed: Nov. 8, 2010

(65) Prior Publication Data

US 2011/0165530 A1 Jul. 7, 2011

Related U.S. Application Data

(60) Provisional application No. 61/292,330, filed on Jan. 5, 2010.

(51) Int. Cl.

| | |
|---|---|
| ***F23D 14/62*** | (2006.01) |
| ***F23M 5/00*** | (2006.01) |
| ***F23M 3/00*** | (2006.01) |
| ***F23C 5/32*** | (2006.01) |
| ***F02C 7/24*** | (2006.01) |

(52) U.S. Cl.

USPC ..... 431/354; 431/114; 431/9; 431/173; 60/725

(58) Field of Classification Search

USPC ..... 431/354, 114, 182, 9, 181, 173; 60/725

See application file for complete search history.

(56) References Cited

U.S. PATENT DOCUMENTS

| | | | | |
|---|---|---|---|---|
| 5,345,768 | A * | 9/1994 | Washam et al. | 60/737 |
| 5,488,829 | A * | 2/1996 | Southall et al. | 60/725 |
| 5,733,114 | A | 3/1998 | Peng et al. | |
| 5,758,587 | A * | 6/1998 | Buchner et al. | 110/260 |
| 6,837,456 | B1 | 1/2005 | Shih et al. | |
| 2006/0242965 | A1 * | 11/2006 | Shi et al. | 60/796 |
| 2008/0000234 | A1 * | 1/2008 | Commaret et al. | 60/748 |

(Continued)

FOREIGN PATENT DOCUMENTS

DE WO 0049337 8/2000

OTHER PUBLICATIONS

Roy, Gabriel D. (2006). Combustion Processes in Propulsion-Control, Noise, and Pulse Detonation. (pp. 231-244).Elsevier.*

(Continued)

*Primary Examiner* — Steven B McAllister
*Assistant Examiner* — Vivek Shirsat
(74) *Attorney, Agent, or Firm* — Sam Pasternack; MIT Technology Licensing Office

(57) ABSTRACT

Combustor. The combustor includes an axially symmetric tube along with means for introducing fuel and air into the tube. A swirler is disposed within the tube to impart rotation in a first direction to the air/fuel mixture. A plurality of holes downstream of the swirler are disposed around the tube and offset at an angle relative to an inward normal to the tube wall. Air is injected through the offset holes to impart rotation to the air/fuel mixture in a second direction opposite to the first direction. A combustion chamber having a diameter larger than that of the tube receives and burns the air/fuel mixture from the tube.

4 Claims, 9 Drawing Sheets

Schematic of swirl combustor

(56) References Cited

U.S. PATENT DOCUMENTS

| | | | | |
|---|---|---|---|---|
| 2008/0092513 | A1* | 4/2008 | Carroni et al. | 60/39.23 |
| 2008/0124669 | A1 | 5/2008 | Loving | |
| 2009/0178412 | A1* | 7/2009 | Spytek | 60/752 |
| 2010/0059311 | A1* | 3/2010 | Agrawal et al. | 181/256 |

OTHER PUBLICATIONS

S. Candel. "Combustion dynamics and control: Progress and challenges." Proceedings of the Combustion institute (2002), vol. 29, 1-28.

J. J. Choi, A. M. Annaswamy, H. Lou, F. S. Alvi. "Active control of supersonic impingement tones using steady and pulsed microjets." Experiments in Fluids (2006), vol. 41, 841-855.

K. R. McManus, T. Poinsot, S. M. Candel. "A review of active control of combustion instabilities." Progress in Energy and Combustion Science (1993), vol. 19, 1-29.

D. E. Hudgins. "Suppresion of premixed combustion dynamics utilizing microjet air injection." S.M. Thesis, MIT (2008).

H. M. Altay. "Vortex driven flame dynamics and combustion instability." Ph.D. Thesis, MIT (2009).

H. M. Altay, R. L. Speth, D. Snarheim, A. F. Ghoniem. "Impact of microjet actuation on stability of backward facing step combustor." 45th AIAA Aerospace Sciences Meeting (2007).

Arakeri, V. H., Krothapalli, A., Siddavaram, V., Alkislar, M. B., and Lourenco, L. M., On the Use Microjets to suppress Trubulence in a Mach 0.9 Axisymmetric Jet, Journal of Fluid Mechanics, vol. 490, pp. 75-98, 2003.

Kumar, R., Lazic, S. and Alvi, F.S., "Control of High-Temperature Supersonic Impinging Jets Using Microjets," AIAA Journal , vol. 47, No. 12, 2009.

Zhuang, N., Alvi, F. A., Alkislar, M. B. and Shih, C., "Supersonic Cavity Flows and Their Control," AIAA Journal, vol. 44, No. 9, 2006.

T. Poinsot, S. M. Candel, E. Esposito. "Suppression of combustion instabilities by active control." Journal of Propulsion and Power (1989), vol. 5, No. 1, 14-20.

S. R. N. de Zilwa, S. Sivasegaram, J. H. Whitelaw. "Control of combustion oscillations close to stoichiometry." Flow, Turbulence and Combustion (1999), vol. 63, 395-414.

Y. Huang, V. Yang. "Dynamics and stability of lean-premixed swirl-stabilized combustion." Progress in Energy and Combustion Science (2010), vol. 35, 293-364.

Z. A. LaBry, S. J. Shanbhogue, R. L. Speth, A. F. Ghoniem. "Instability suppression in a swirl-stabilized combustor using microjet air injection." Proceedings of the 48th AIAA Aerospace Sciences Meeting (2010), AIAA-2010-1524.

Z. A. LaBry. "Suppression of thermoacoustic instabilities in a swirl combustor through microjet air injection." S.M. Thesis, MIT (2010).

Z. A. LaBry, S. J. Shanbhogue, R. L. Speth, A. F. Ghoniem. "Flow structures in a lean-premixed swirl-stabilized combustor with microjet air injection." Proceedings of the Combustion Institute, In Press (2010).

The International Search Report and Written Opinion issued in connection with International Patent Application No. PCT/US2010/061508 mailed on Apr. 6, 2011.

* cited by examiner

Drawing of injection ports

Drawing of injector plenum

Sketch of injector assembly

Effect of SCS Microjets on OASPL for $C_3H_8$ (propane)

Effect of SCS Microjets on the SPL
at different frequencies for $C_3H_8$ (propane)

Effect of mass flow rate through SCS Microjet on propane / air flames

Injection of 1.2 g/s (12% total mass flow)

Injection of 2.0 g/s (18% total mass flow)

Effect of SCS Microjets on OASPL for various blends of $CO/H_2$ (syngas)

Radial, Counter-swirling (SCS) Microjets

Axial, Counter-swirling Microjets

Radial, Straight Microjets

Axial, Straight Microjets

Radial, Co-swirling Microjets

Axial, Co-swirling Microjets

Effect of various microjet configurations on $C_3H_8$ (propane) flame

Effect of injection angle for SCS Microjets on propane/air flames

Flame image in lean stable mode without microjets

Flame image in SCS microjet stabilized mode

SWIRL-COUNTER-SWIRL MICROJETS FOR THERMOACOUSTIC INSTABILITY SUPPRESSION

This application claims priority to provisional patent application Ser. No. 61/292,330 filed Jan. 5, 2010, the contents of which are incorporated herein by reference.

This invention was made with Government support under Grant No. DE-FC26-02NT41431, awarded by the Department of Energy. The Government has certain rights in this invention.

BACKGROUND OF THE INVENTION

This invention relates to combustors and more particularly to a swirl-stabilized combustor operating in a lean-premixed mode that mitigates high-amplitude, discrete-frequency, self-sustaining pressure oscillations within a certain window of operating conditions.

Combustion technologies remain one of the most power-dense sources of energy. Even with the emergence of alternative energy sources, combustion is necessary to keep up with energy demands, and irreplaceable within some domains of application.

The chemical products of combustion are often undesirable, being implicated in everything from local health and environmental damage to global climate change. One of the major classes of pollutants emitted by combustors is nitric oxide (NO and $NO_2$, collectively known as $NO_x$). $NO_x$ can be formed thermally as otherwise inert atmospheric $N_2$ reacts at high temperatures. Lean-premixed combustion has been shown to substantially reduce $NO_x$ emissions from conventional non-premixed combustion by improving mixing and lowering the flame temperature. Lean-premixed combustion is very susceptible to combustion instability, however, which is a coupling between the acoustics, flowfield and reaction zones within the combustor that lead to strong pressure oscillations.

The acoustic oscillations in these combustors can reach unacceptably high levels. While such oscillations can, in principle, run afoul of noise pollution regulations, they also pose a danger to the operation of combustors in the premixed mode. Strong, discrete pressure oscillations are capable of causing mechanical damage to the combustor or nearby machinery. These pressure oscillations are accompanied by strong oscillations in the flow velocity, which can grow to sufficiently large amplitudes to cause flame blow-off or flashback.

Increasing focus on producing power with lower emissions has been a driving force in the study of the dynamics of lean premixed combustion systems. Work has progressed along two tracks: understanding the underlying physical mechanisms and developing strategies and models that can be used to suppress combustion instability and make lean premixed combustors practical devices [1]. Numbers in brackets refer to the references appended hereto. The contents of all of these references are incorporated herein by reference.

In a non-reacting domain, microjets have found use in the control of supersonic jet instabilities [2,3]. Air injection is accomplished through ports ("microjets") whose area is small compared to that of the main jet. In this context, the microjets are used to alter the flow field, but are not used to add longitudinal angular momentum to the flow.

Microjets have also found application in the suppression of combustion instability for non-swirling flows. Initial application of microjet injectors for combustion instability looked at the injection of fuel into the flow [4].

The injection of air through microjets in the streamwise direction ("axial" injection) and in the cross-stream direction ("normal" injection) have both demonstrated the capability of reducing or suppressing combustion instability in a backward-facing step combustor under various conditions [5, 6, 7]. By injecting air, rather than fuel, through the microjets, the creation of locally fuel-rich fuel/air mixtures is avoided.

The backward-facing step combustor features a rectangular cross section and a discontinuous increase in the area of the channel in which combustion takes place (the backward-facing step). This step allows the flame to anchor, but also provides a geometrically favorable location for vortex shedding to occur. Similar area expansions are commonly used in practical combustors as a means of controlling where the flames anchor. Axial microjets were located on the downstream face of the step, injecting air toward the exhaust. Normal microjets were located on the upper face of the step, injecting air across the mean flow immediately before the expansion. The success of these microjets in reducing the amplitude of certain frequencies of instability at different operating equivalence ratios (see the cited references for details) provided the initial inspiration for the use of microjets in the swirl-stabilized combustor.

Researchers have explored methods for mitigating these self-sustaining pressure oscillations. Arakeri, et al. explored the use of microjets in a high-velocity jet for the reduction of turbulent noise intensity [8]. In Arakeri, microjets were mounted at an angle to the flow in the plane formed by the radius and longitudinal axis. The microjets were angled so that the flow coming out of the jets had velocity components in the streamwise and inward radial directions. These microjets did not introduce swirl in the flow. The authors were able to show a reduction of 2 dB in intensity of the turbulent noise.

Kumar, et al. [9] studied the use of microjets to stabilize high-speed impinging jets, particularly as they are applied to vertical take-off and landing aircraft. These researchers were able to reduce the noise by 15 to 20 dB, and improve the lift-to-drag characteristics of the impinging jet. Microjets were aimed in the streamwise direction, slightly angled in the radial direction. They did not introduce swirl into the flow.

Altay, et al. [7] explored the use of microjet actuation for suppressing combustion instability in a backward-facing step combustor. Their results showed that microjet injection of air into the flame anchoring zone provided a simple means of reducing the intensity of combustion instability in certain operating regimes. They examined the use of streamwise and perpendicular microjets.

Zhuang, et al. [10] investigated microjet injection for suppression of instabilities in a supersonic cavity flow. Microjets aimed normal to the mean direction of the supersonic flow were located on the outside upper lip of a cavity. Microjet actuation produced a 20 dB reduction in sound pressure level under specific conditions.

It is an object of the present invention to provide a combustor that mitigates high-amplitude, discrete-frequency, self-sustaining pressure oscillations capable of reducing overall sound pressure levels by up to 17 dB within a certain window of operation conditions.

SUMMARY OF THE INVENTION

The combustor according to the invention includes an axially symmetric tube and means for introducing fuel and air into the tube. A swirler is disposed within the tube to impart rotation in a first direction to the air/fuel mixture. A plurality of holes downstream of the swirler are disposed around the tube and offset at an angle relative to an inward normal to the tube wall. Air is injected through the offset holes to impart rotation to the air/fuel mixture in a second direction opposite to the first direction. A combustion chamber having a diameter larger than that of the tube receives and burns the air/fuel mixture from the tube.

In a preferred embodiment, the holes have a small diameter and the air is injected at high velocity with a low mass flow rate. The combustion chamber may be a quartz tube. A suitable fuel is propane.

DESCRIPTION OF THE PREFERRED EMBODIMENT

Strategies for controlling combustion instability fall into two categories: active control and passive control. Active control seeks to combine close monitoring of the state of the combustor through sensors coupled to the operation of actuators to prevent oscillations in the system from growing outside of reasonable limits (defined in context of the specific system, designed operation, and operating limits). The goal of passive stability is the development of a combustor, operating regime, actuator, or combination of these elements that operates in a stable mode without active sensing and actuation.

The simplest form of passive instability suppression comes in the form of an acoustic damper—a cavity designed and affixed to the combustor in order to create interference with the acoustic field of the instability itself. An example of an acoustic damper is the Helmholtz resonator. Acoustic dampers do not prevent the onset of instability, but reduce the amplitude of instabilities that do occur. They must be designed to cancel each frequency of instability encountered over the operating range and add substantial amount of mass and complexity to the combustor design.

A major challenge for active control strategies has been the development of robust and effective actuators. Loudspeakers have been investigated as actuators for use in active combustion control [11]. These speakers were used to create an acoustic field to oppose that created by combustion instability, although these have only achieved moderate effectiveness.

Many strategies have looked at injecting additional fuel or modifying the means by which fuel is added to the flow. Active control of fuel flow rates, thus dynamically varying the equivalence ratio of the mixture has been explored as an actuator mechanism [12]. Pilot fuel injection and fuel staging have also been the subject of much study, primarily for passive control [13]. The major drawback of techniques that rely on modulating or staging the fuel supply is that they sacrifice some of the potential emission reductions that are possible with lean-premixed combustion.

Figure 1:
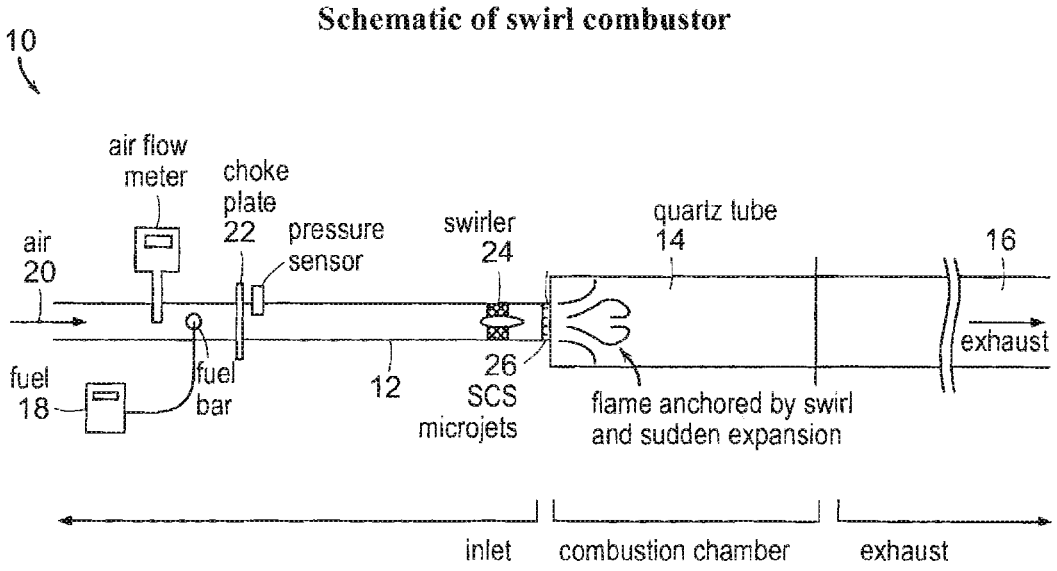
FIG. 1 is a schematic illustration of a combustor according to one embodiment of the invention.

Our invention is a swirl-stabilized combustor featuring Swirl-Counter-Swirl (SCS) Microjets. A schematic of the combustor 10 is shown FIG. 1. It includes a cylindrical inlet pipe 12, a combustion chamber 14, and an exhaust 16. The inlet diameter is 38 mm. Fuel 18 is injected into air 20 in the upstream section. The flow passes through a choke plate 22, and downstream through a mixing section. Premixed flow passes through a swirler 24, before entering the combustion chamber 14 with a diameter of 78 mm. The transition between the inlet and the combustion chamber 14 is a step expansion. The combustor 10 is typically operated at Reynolds numbers between 19000 and 25000, based on the change in radius between the inlet and the combustion chamber 14.

Figure 2:
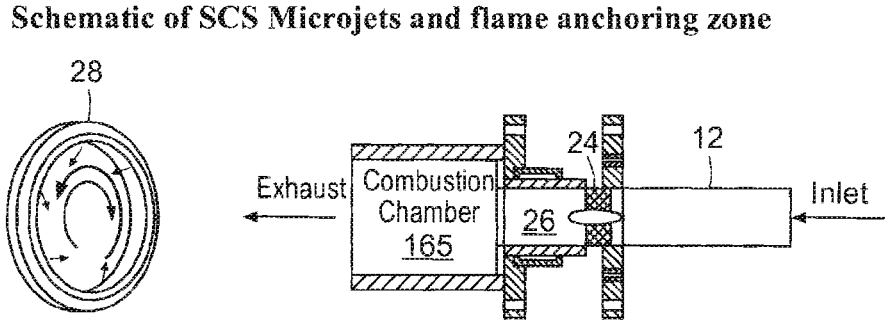
FIG. 2 is a schematic illustration showing the swirl-counter-swirl microjets and flame anchoring zone.
Figure 3:
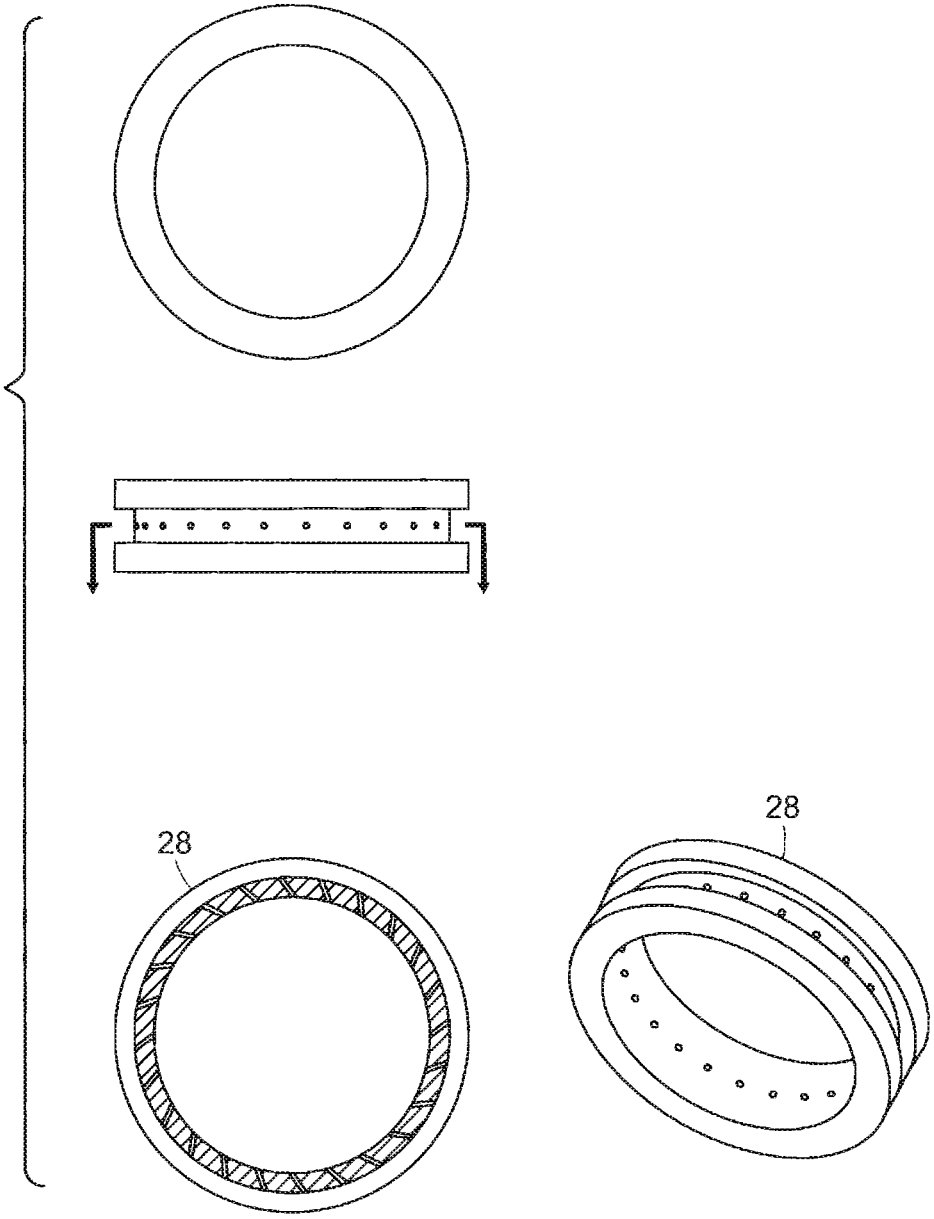
FIG. 3 includes cross-sectional and perspective views of the injection ports.
Figure 4:
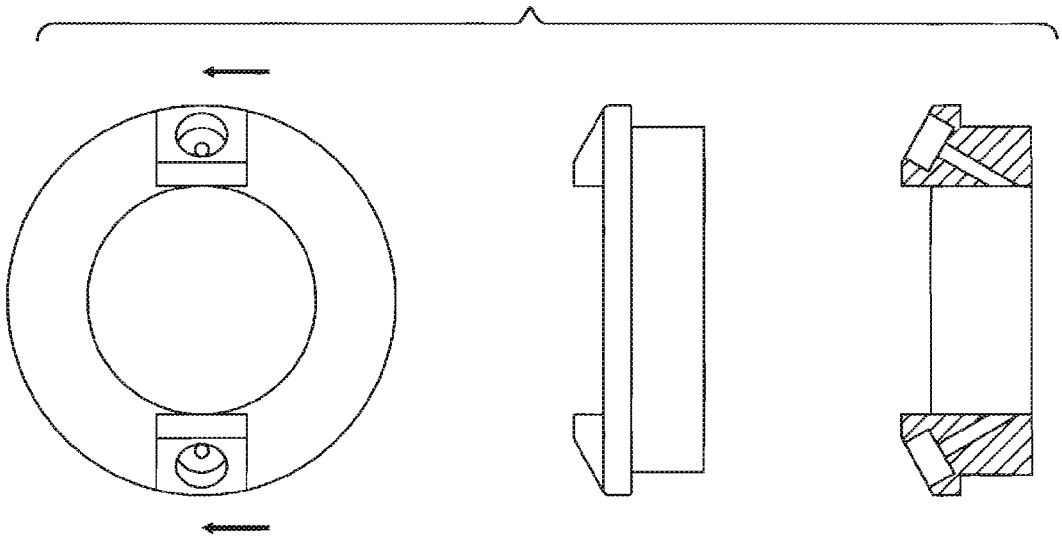
FIG. 4 are sectional views of the injector plenum disclosed herein.
Figure 5:
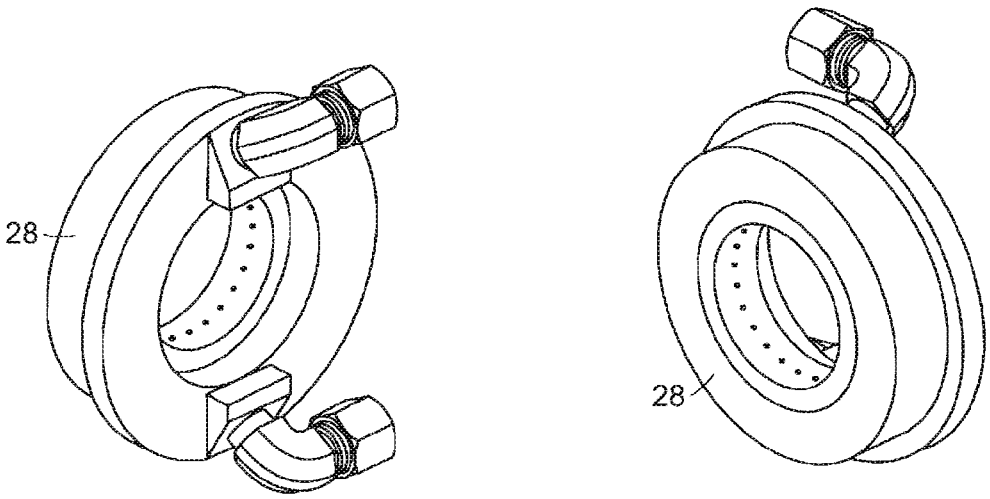
FIG. 5 are perspective views of the injector assembly according to an embodiment of the invention.

The SCS Microjets 26 include small ports (compared to the radius of the inlet) through which secondary flow is injected immediately upstream of the combustion chamber 14. Secondary flow is injected in a plane normal to the longitudinal axis of the combustion chamber 14. The injector ports are mounted radially around an injector ring 28 (see FIG. 2). The ports are angled so that streamlines at the exit to each port have a radially inward component and a tangential component opposite to the tangential direction of the main airflow. Design drawings are shown in FIG. 3, FIG. 4 and FIG. 5 for 225 a preferred embodiment of the invention.

Tests were conducted at a fixed Reynolds number (calculated based on the properties of the incoming species and the radial expansion from the inlet to the combustion chamber). The inlet equivalence ratio is varied between an arbitrary upper limit and the lean blowoff limit of the combustor 10. Instability modes are distinguished by their dominant frequency of oscillation and numbered starting with the lowest frequency (which also corresponds to the lowest equivalence ratio). The two modes of interest in the leanest regime of operation are Mode I at 40 Hz and Mode II at 105 Hz.

Figure 6:
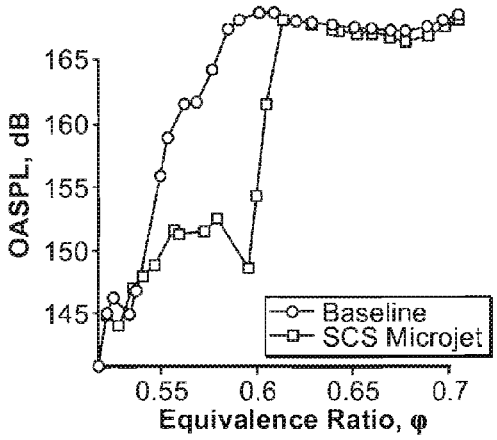
FIG. 6 is a graph of overall sound pressure level as a function of the equivalence ratio.
Figure 7A:
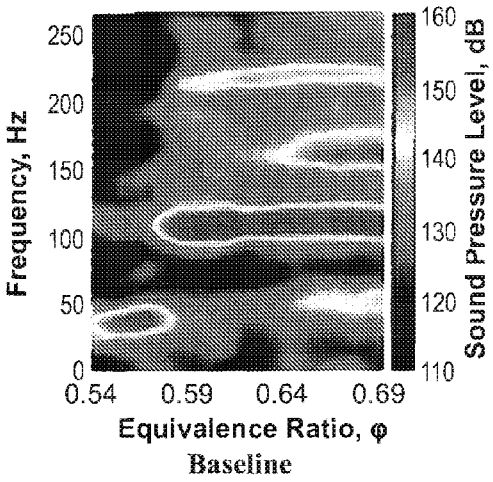
FIGS. 7*a* and 7*b* are plots of sound pressure level as a function of frequency.
Figure 7B:
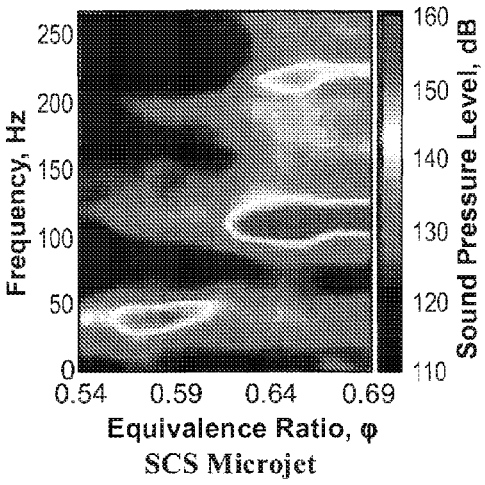

The performance of the combustor 10 and SCS Microjet system 26 is shown in FIG. 6. The overall sound pressure level (OASPL) is plotted as a function of the operating equivalence ratio. The equivalence ratio accounts for the dilution effect of the secondary air injection (when microjets are active). The results show a reduction in the OASPL over a relatively wide range of lean equivalence ratios. Examination of the sound pressure level (SPL) as a function of frequency in FIG. 7 shows that, without microjets 26, Mode I is dominant at a low equivalence ratio and Mode II is dominant at a higher equivalence ratio. The SCS Microjets suppress Mode II at the lean end of its operating range and, in addition to reducing the OASPL, they eliminate any coherent pressure oscillations.

The primary configuration injected air at an angle of 35° from the radial direction. This is the injection angle used for all "co-swirling" and "counter-swirling" tests unless otherwise explicitly noted.

Figure 8A:
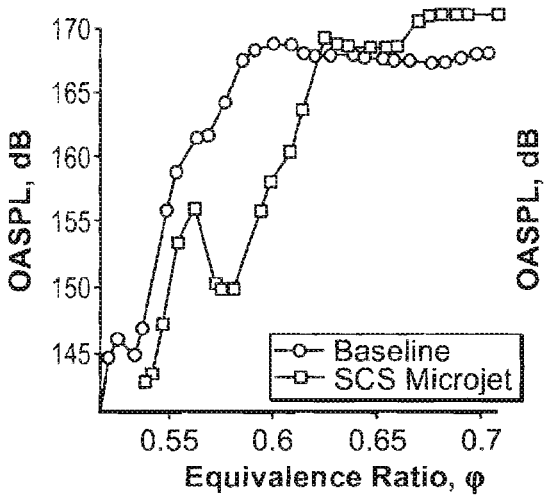
FIGS. 8*a* and 8*b* are graphs of overall sound pressure level against equivalence ratio at different mass flow rates.
Figure 8B:
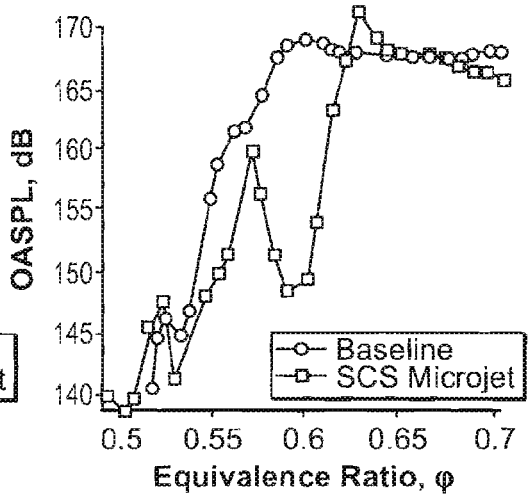
Figure 9A:
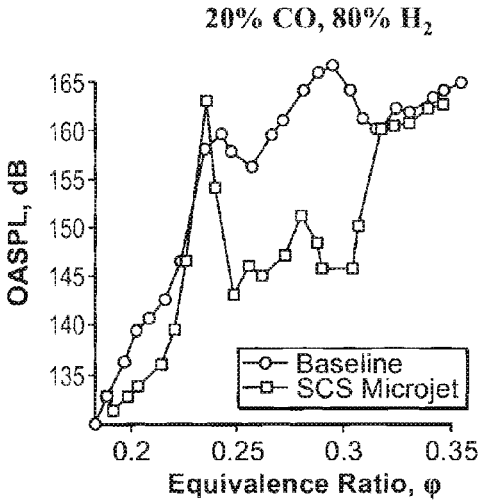
FIGS. 9*a, b, c* and *d* are graphs of overall sound pressure level versus equivalence ratio for various fuel blends.
Figure 9B:
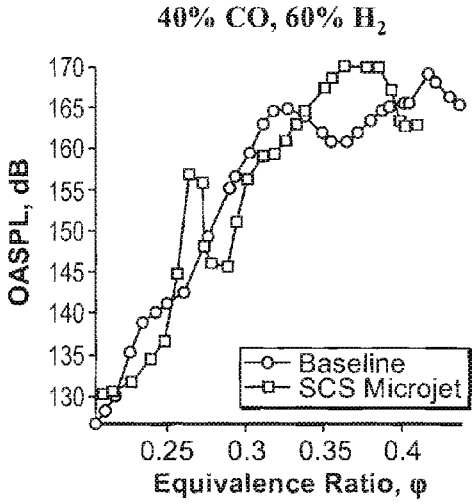
Figure 9C:
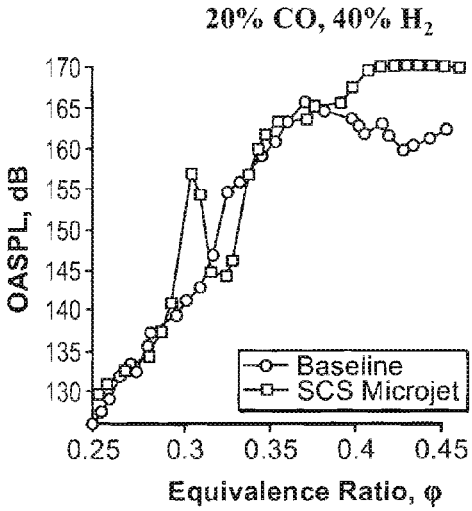
Figure 9D:
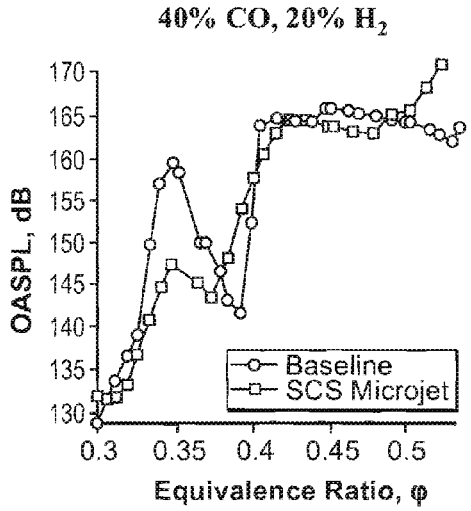
Figure 10A:
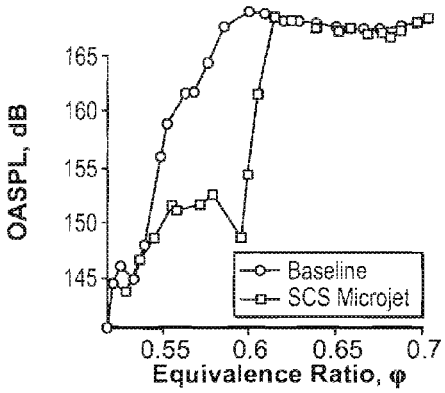
FIGS. 10*a, b, c, d, e* and *f* are graphs of overall sound pressure level versus equivalence ratio for various microjet configurations.
Figure 10B:
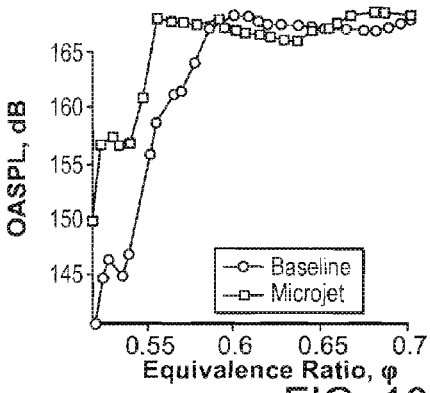
Figure 10C:
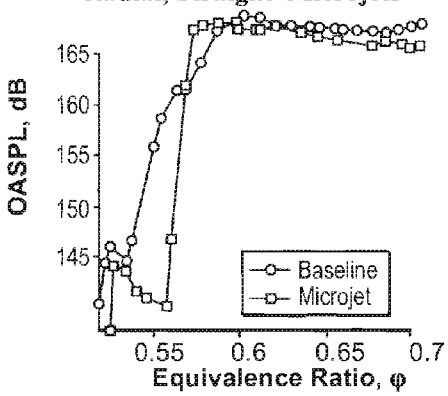
Figure 10D:
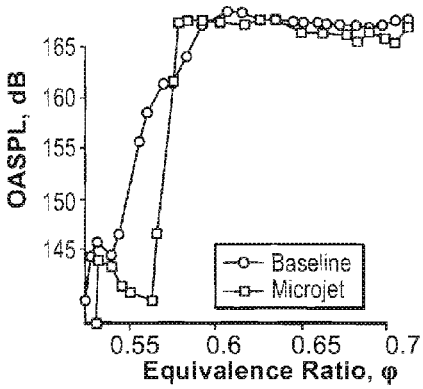
Figure 10E:
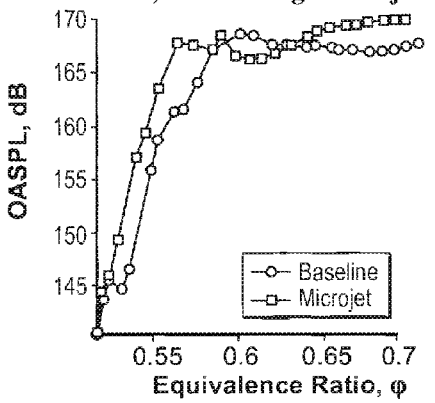
Figure 10F:
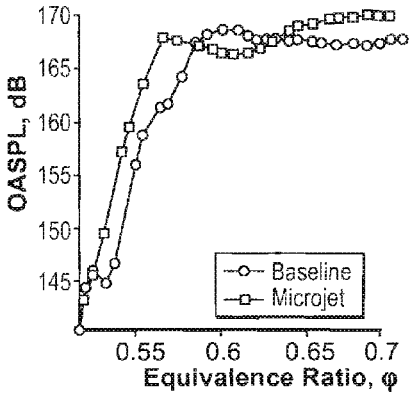

SCS Microjets were also tested at several different mass flow rates. In addition to a mass flow rate of 1.6 g/s (15% of the total mass flow) that was held fixed for all other data presented in this document, flow rates of 1.2 g/s (12% of the total mass flow) and 2.0 g/s (18% of the total mass flow) were also examined (see FIG. 8). The dynamics of Mode I differ, but the SCS Microjets still significantly reduce the OASPL.

Synthesis gases, composed of varying mixtures of CO and $H_2$, also encounter similar instabilities to hydrocarbon fuels when operated in lean premixed mode. Blends ranging from 80% $H_2$ to 20% $H_2$ were tested. The Reynolds number was maintained at 19000, and the secondary airflow rate through the microjets was held at a constant 1.6 g/s (15% of the total mass flow).

Overall sound pressure level curves, shown in FIG. 9, show that although the microjets 26 are not universally effective at suppressing combustion dynamics, significant reductions in the amplitude of the pressure oscillations are achieved for both high CO and high $H_2$ fuels.

Other microjet configurations were tested as well, covering six qualitatively different designs. Two parameters were varied: the direction of the injection and the induced sense of swirl. The direction could be either radial or axial. "Radial" microjets have no component of velocity in the streamwise direction, whereas "axial" microjets are skewed to the longitudinal axis of the combustor. The sense of swirl could be either "counter," implying a tangential velocity opposite to that of the main air, "co," implying a tangential velocity in the same direction as the main air, or "straight," implying either purely radial or purely axial injection.

Test results from the full matrix are shown in FIG. 10, including the SCS Microjets in FIG. 10(*a*). The SCS Microjet configuration is the only configuration of the six tested that significantly reduces the OASPL over a wide range of equivalence ratios. Some reduction in the SPL of Mode I is achieved for straight air injection, however, the stable operating range (above the lean blowoff limit) is comparatively small relative to the SCS Microjets.

Figures 11A, 11B:
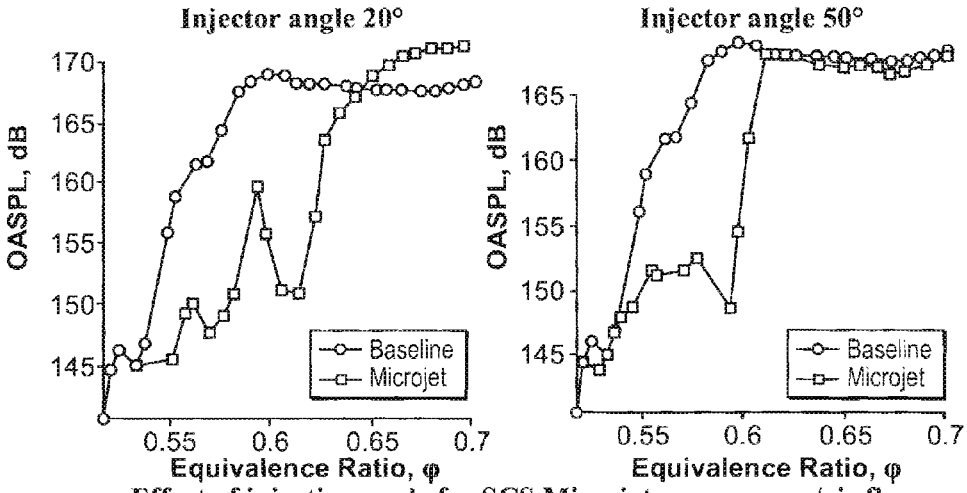
FIGS. 11*a* and *b* are graphs of overall sound pressure level versus equivalence ratio showing the effect of injection angle.

The SCS Microjets were tested at two additional injection angles: 20° and 50°. The effect on the OASPL is shown in FIG. 11. The observed behavior is qualitatively similar to the 35° SCS Microjets. There are more active dynamics for the lower injection angle (closer to the "straight" configuration) than in either the 35° injector or the 50° injector, and the 35° injector marginally outperforms the 50° injector. This data suggests that there is some unfound optimum injection angle, but that the SCS Microjet configuration is unique among the variants that were considered.

The final characteristic of interest is the compactness of the flame. In order to obtain complete combustion of the fuel 18 inside the combustion chamber 14, the chamber 14 must be sized appropriately. Although minimizing space requirements is desirable for application in power plants, it is critical for use in aircraft engines. Large combustors increase the overall size, and hence, mass of the engines. This serves to reduce the overall efficiency of the system by using fuel to carry non-payload mass. Furthermore, larger engines are likely to lead to larger structures, subsequently incurring drag penalties.

Figure 12:
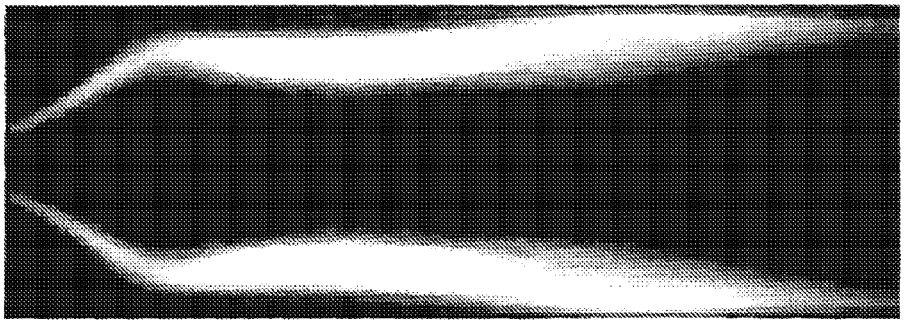
FIG. 12 is a flame image in lean stable mode without microjets.

The stable flame that is observed near the lean limit of the combustor 10 without microjet injection is considered to be relatively non-compact (see FIG. 12). The flame extends 220 mm downstream of the expansion (approximately 2.9 times the diameter of the expansion).

Figure 13:
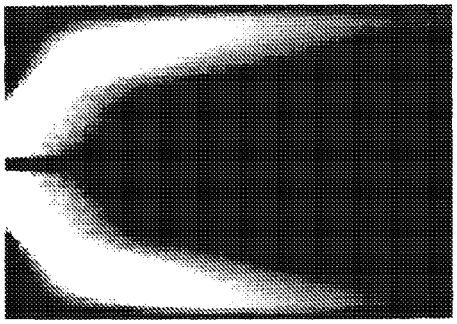
FIG. 13 is a flame image in a SCS microjet stabilized mode.

The microjet stabilized flame, operating at a higher equivalence ratio, is significantly more compact, extending 115 mm (or 1.5 diameters) downstream of the expansion (see FIG. 13).

Figure 14:
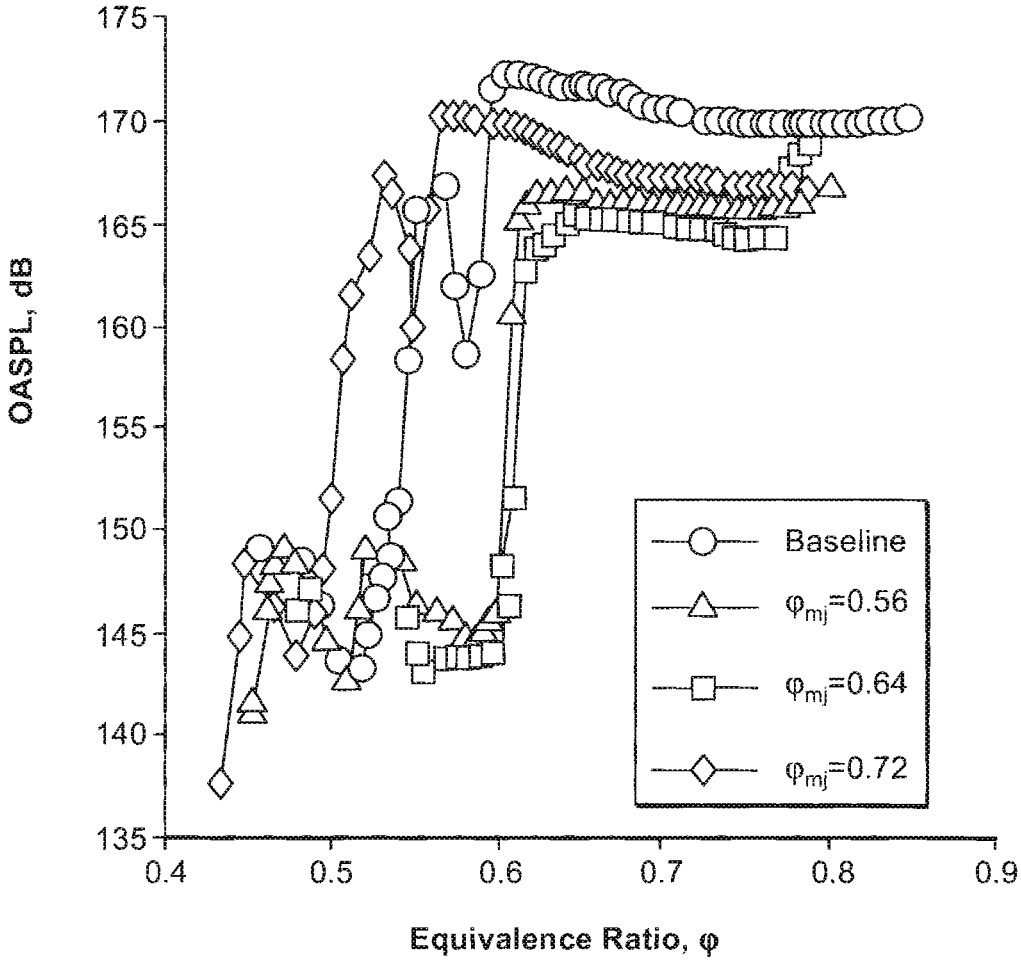
FIG. 14 is a graph of overall sound pressure level versus equivalence ratio when a premixed fuel/air mixture is introduced through the microjets.

In another embodiment, a premixed fuel/air mixture was introduced through the microjets rather than just air as in the earlier embodiments. In an experiment, we added a manual flow controller well upstream of the microjet injectors that allowed us to measure the OASPL and observe the flame while varying the equivalence ratio of the main fuel/air mixture and holding the microjet injection at a fixed equivalence ratio. Three different equivalence ratios were tested: 0.56, 0.64, and 0.72. At the first two equivalence ratios, the microjets substantially reduced the OASPL in the combustor. See FIG. 14. We were unable to stabilize the combustor at the higher equivalence ratio. The flame observed was similar to that seen in the air only microjet tests, and was extremely steady.

The injection of a premixed fuel/air mixture thus provides for stable operation of the combustor and supports the notion that the mechanism of flame stabilization is of fluid dynamic origin.

The intended application of this invention is for the combustors of continuous combustion systems, such as power plants, industrial burners, power generation for small and large scale distributed generation, small and large scale boilers for heating and power, and turbine engines for aircraft. Continuous combustion systems continue to have some of the highest available power densities, but the chemical processes involved lead to the creation and emission of pollutants. In particular, the invention is intended to help mitigate the emission of nitric oxides ($NO_x$) from combustors.

The microjets that we have developed work through the modification of the flowfield in the flame anchoring zone, rather than through modifications to the chemistry or the acoustic field, and are intended for use with hydrocarbon fuels (such as in aircraft and power plants), with hydrogen-enriched fuels (such as modern power plants burning synthesis gases) or with pure hydrogen. In the latter case, carbon dioxide emissions are eliminated such as in the case of carbon capture plants using IGCC technologies.

It is recognized that modifications and variations of the invention disclosed herein will be apparent to those of ordinary skill in the art and it is intended that all such modifications and variations be included within the scope of the appended claims.

REFERENCES

1. S. Candel. "Combustion dynamics and control: Progress and challenges." Proceedings of the Combustion Institute (2002), vol. 29, 1-28.
2. J. J. Choi, A. M. Annaswamy, H. Lou, F. S. Alvi. "Active control of supersonic impingement tones using steady and pulsed microjets." Experiments in Fluids (2006), vol. 41, 841-855.
3. C. Shih, F. S. Alvi, A. Krothapalli. "Microjet based control system." U.S. Pat. No. 6,837,456 (2005).
4. K. R. McManus, T. Poinsot, S. M. Candel. "A review of active control of combustion instabilities." Progress in Energy and Combustion Science (1993), vol. 19, 1-29.
5. D. E. Hudgins. "Suppression of premixed combustion dynamics utilizing microjet air injection." S. M. Thesis, MIT (2008).
6. H. M. Altay. "Vortex driven flame dynamics and combustion instability." Ph.D. Thesis, MIT (2009).
7. H. M. Altay, R. L. Speth, D. Snarheim, A. F. Ghoniem. "Impact of microjet actuation on stability of backward facing step combustor." 45$^{th}$ AIAA Aerospace Sciences Meeting (2007).

8. Arakeri, V. H., Krothapalli, A., Siddavaram, V., Alkislar, M. B., and Lourenco, L. M., "On the Use of Microjets to suppress Trubulence in a Mach 0.9 Axisymmetric Jet", Journal of Fluid Mechanics, Vol. 490, pp. 75-98, 2003.
9. Kumar, R., Lazic, S, and Alvi, F. S., "Control of High-Temperature Supersonic Impinging Jets Using Microjets," AIAA Journal , Vol. 47, No. 12, 2009.
10. Zhuang, N., Alvi, F. A., Alkislar, M. B. and Shih, C., "Supersonic Cavity Flows and their Control," AIAA Journal, Vol. 44, No. 9, 2006.
11. T. Poinsot, S. M. Candel, E. Esposito. "Suppression of combustion instabilities by active control." Journal of Propulsion and Power (1989), vol. 5, no. 1, 14-20.
12. S. R. N. de Zilwa, S. Sivasegaram, J. H. Whitelaw. "Control of combustion oscillations close to stoichiometry." Flow, Turbulence and Combustion (1999), vol. 63, 395-414.
13. Y. Huang, V. Yang. "Dynamics and stability of lean-premixed swirl-stabilized combustion." Progress in Energy and Combustion Science (2010), vol. 35, 293-364.
14. Z. A. LaBry, S. J. Shanbhogue, R. L. Speth, A. F. Ghoniem. "Instability suppression in a swirl-stabilized combustor using microjet air injection." Proceedings of the 48$^{th}$ AIAA Aerospace Sciences Meeting (2010), AIAA-2010-1524.
15. Z. A. LaBry. "Suppression of thermoacoustic instabilities in a swirl combustor through microjet air injection." S. M. Thesis, MIT (2010).
16. Z. A. LaBry, S. J. Shanbhogue, R. L. Speth, A. F. Ghoniem. "Flow structures in a lean-premixed swirl-stabilized combustor with microjet air injection." Proceedings of the Combustion Institute, In Press (2010).

What is claimed is:

1. Combustor comprising:

an axially symmetric tube through which an air/fuel mixture flows;

a swirler disposed within the tube to impart rotation in a first direction to the air/fuel mixture;

a plurality of holes downstream of the swirler disposed around the tube and offset at an angle relative to an inward normal to the tube wall;

independent control means for injecting secondary air through the offset holes at sonic velocity to impart rotation to the air/fuel mixture within the tube in a second direction opposite to the first direction; and a combustion chamber having a step expansion to a diameter larger than that of the tube for receiving and burning the air/fuel mixture from the tube, wherein low frequency oscillations are suppressed.

2. The combustor of claim 1 wherein the holes have a small diameter.

3. The combustor of claim 1 wherein the combustion chamber is a quartz tube.

4. The combustor of claim 1 wherein the fuel is propane.

* * * * *